US005215277A

United States Patent [19]

Hajduch

[11] Patent Number: 5,215,277

[45] Date of Patent: Jun. 1, 1993

[54] AUTOMATIC RETRIEVER AND RECYCLING APPARATUS

[76] Inventor: James D. Hajduch, P.O. Box 552, Whiting, Ind. 46394

[21] Appl. No.: 735,160

[22] Filed: Jul. 23, 1991

Related U.S. Application Data

[63] Continuation of Ser. No. 387,609, Jul. 28, 1989, abandoned.

[51] Int. Cl.[5] ..... B65H 17/02

[52] U.S. Cl. ..... 242/67.1 R; 242/67.3 R; 242/68

[58] Field of Search ..... 242/67.1 R, 67.1 D, 242/75.1, 75.5, 71.9, 67.3, 68; 100/155 R; 70/62; 292/292

[56] References Cited

U.S. PATENT DOCUMENTS

| | | | |
|---|---|---|---|
| 268,809 | 12/1882 | Larkin et al. | 100/155 R |
| 649,694 | 5/1900 | Hunter | 242/67.1 R |
| 1,857,817 | 5/1932 | McCann | 242/75.11 |
| 2,192,819 | 3/1940 | Smith | 200/61.18 X |
| 2,789,776 | 3/1957 | Begun et al. | 242/67.3 X |
| 3,028,110 | 3/1962 | Kabelitz | 242/45 |
| 3,113,742 | 12/1963 | Bevan et al. | 242/67.1 |
| 3,281,090 | 10/1966 | Baranowski, Jr. | 242/67.3 |
| 3,447,657 | 6/1969 | Majors | 197/133 |
| 3,857,527 | 12/1974 | Kranz | 242/75.5 |
| 4,061,287 | 12/1977 | Shakespeare | 242/67.1 R |
| 4,168,038 | 9/1979 | Nims | 242/56 R |
| 4,252,283 | 2/1981 | Maxwell | 242/67.17 |
| 4,346,854 | 8/1982 | Markus et al. | 242/67.1 R |
| 4,357,140 | 11/1982 | Phillips et al. | 242/67.1 R X |
| 4,372,694 | 2/1983 | Bovio et al. | 400/88 |
| 4,548,436 | 10/1985 | Cole, Jr. | 292/292 |
| 4,824,036 | 4/1989 | Buta | 242/7.19 |
| 4,848,945 | 7/1989 | Sone | 400/649 |

*Primary Examiner*—Stuart S. Levy
*Assistant Examiner*—Joseph A. Rhoa
*Attorney, Agent, or Firm*—Frank J. Uxa

[57] ABSTRACT

An apparatus for winding paper having spaced apart first and second walls having first and second through slots (72, 74), respectively; a spool sub-system adapted to receive the paper and around which the paper is wound, the spool subsystem including the following components: a spool to receive the paper and being located between the first and second walls, a drive rod (44) adapted to be placed in the first and second through slots and to which the spool is secured, and a rod gear assembly (52) secured to the drive rod and providing mechanical communication between the spool sub-system and motor; first and second pins (60, 62) removably secured to the first and second walls, respectively, and acting to hold the drive rod in place in the first and second through slots; and a motor (58) associated with the spool sub-system and being capable of rotating the spool sub-system to thereby cause the paper to be wound around the spool.

17 Claims, 3 Drawing Sheets

10
62
70
74
48
42
58
16
82
22
2
46
32
40
28
36
30
60
72
44
38
26
20
14
34
18
84
2
12

10
60
16
42
4
34
24
22
66
46
28
72
30
38
26
20
4
78
78
32
44
64
84
12

AUTOMATIC RETRIEVER AND RECYCLING APPARATUS

This application is a continuation of application Ser. No. 387,609, filed Jul. 28, 1989, now abandoned.

BACKGROUND AND SUMMARY OF THE INVENTION

The present invention relates to an apparatus for winding paper and the like materials. More particularly, the invention relates to a system for winding paper and the like materials as such paper or other material becomes available for such winding.

Rolls of paper and the like materials are useful for many purposes. For example, rolls of paper are used for printing by such devices as adding machines, calculators, computers and the like. Often, only one side of the paper is printed upon and the paper is discarded. The other side of the paper is perfectly acceptable for printing use except that, prior to the present invention, no system has been available to allow efficient and effective use of the other side of the paper. It clearly would be desirable to provide such a system to enable use of both sides of the paper. Also, many prior art paper winding machines are relatively complex, involving springs and the like, and are, therefore, quite difficult to operate, particularly when the operator is visually impaired or otherwise physically handicapped.

Therefore, one object of the present invention is to provide an apparatus, e.g., a relatively simple and straight forward to operate apparatus, for winding paper and the like materials.

Another object of the invention is to provide an apparatus to enable use of the unused side of a roll of paper and the like materials one side of which has already been used, e.g., printed and/or written upon.

A still further object of the present invention is to provide an apparatus capable of winding paper and the like materials of differing widths. These and other objects and advantages of the present invention will become available hereinafter.

An apparatus for winding paper and the like materials has been discovered. The terms "paper" "and paper and the like materials" are used interchangeably herein and refer to one or more materials, such as those conventionally used, capable of being provided in rolls for use as a printing medium for devices such as typewriters, adding machines, cash registers, calculators, computers and various other printing systems.

The present apparatus comprises spaced apart first and second walls having first and second through slots, respectively; spool means adapted to receive the paper and around which the paper is wound; and motive means associated with the spool means and capable of rotating the spool means to thereby cause the paper to be wound around the spool means. The spool means includes a spool to receive the paper, the spool when in use being located between the first and second walls; a drive rod adapted to be placed in the first and second through slots, each preferably with one open end, and to which the spool is secured; and a rod gear assembly secured to the drive rod and providing mechanical communication between the spool means and the motive means. First and second pins removably secured to the first and second walls, respectively, are provided. These pins act to hold the drive rod in place in the through slots. Thus, simply by removing the pins from the walls, one can easily and simply remove or detach the spool means, preferably as a single integral unit, from the remainder of the apparatus, e.g., after the spool is filled with paper and/or to replace the spool. A new spool means can be easily and simply attached to the apparatus by passing the drive rod into the through slots and engaging the pins to the walls. No springs or pawls are employed or activated to provide for this detachment and/or attachment of the spool means. Thus, the present system can be conveniently and safely used by a physically handicapped person. In particular, the tactile nature of the present system allows use by visually impaired individuals with reduced risk of misoperation of the system and with reduced danger to the operator.

The system is particularly useful when employed in conjunction with a printing device or system, e.g., such as those noted previously. Thus, as such printing device or system prints on one side of the paper, the partially used paper becomes available for winding by the present apparatus. The present system, and in particular the present activator means, senses the presence of such paper to be wound (as will be described in detail hereinafter) and such paper is wound around the spool means until there is no paper available to be wound. At this point, the motive means is deactivated and the spool means stops rotating. As more paper to be wound becomes available from the printing device or system, the cycle is repeated.

The present apparatus provides an effective, efficient and reliable means to wind paper, e.g., thereby making the second side of a roll of paper useable as a printing medium. This apparatus is adaptable to be used in conjunction with a printing device or system to wind paper previously used by such device or system as the paper is used. The present apparatus preferably winds paper only when such paper is available for winding and is preferably capable of responding to the presence of such paper to be wound. In short, the present system provides for convenient and automatic (i.e., without human intervention) winding of paper, particularly for use of the second side of paper as a printing medium.

In one preferred embodiment, the present spool means is adjustable to allow paper of differing widths to be wound. This feature adds to the flexibility of the present apparatus. In a further preferred embodiment, the spool means includes a gear assembly to provide mechanical communication between the spool means and the motive means. Such gear assembly acts to facilitate rotation of the spool means by the motive means.

Preferably, the motive means comprises an electric, more preferably an alternating current (A. C.) motor. Alternately, the motive means can be powered by a direct current (D. C.) source, such as solar cells, one or more storage batteries and the like. In this embodiment, a high torque, low voltage D. C. motor is employed, thus eliminating the need for a relay and A. C. power source. The use of electricity as the power source for the motive means provides for improved co-ordination with the activator means (which is also preferably electrically powered) and adds to the convenience of the present apparatus. However, other sources of power may be used to drive the motive means, provided that the motive means functions as set forth herein.

An activator means associated with the motive means is preferably provided and is capable of activating the motive means to rotate the spool means in response to the presence of paper to be wound. The activator means, which at least indirectly senses the presence of paper to be wound, preferably includes a contact switch assembly. This contact switch has an open position in which the activator means does not activate the motive means, and a closed position in which the activator means does activate the motive means. The contact switch assembly moves from the open position to the closed position in response to the presence of paper to be wound. For example, in one embodiment when no paper is available to be wound, a segment of paper physically holds the contact switch assembly in the open position. In this embodiment, as paper becomes available to be wound, the paper can no longer hold the contact switch assembly in the open position, and gravity forces the contact switch into its closed position. As the paper is wound, the segment of paper in contact with the contact switch assembly becomes taut and forces the contact switch assembly into the open position, thus deactivating the motive means. In this manner and in the embodiment, the contact switch assembly cycles between the open and closed positions in response to the absence or presence of paper to be wound.

In a further preferred embodiment the activator means includes off switch means capable of being activated to render the activator means unresponsive to the presence of paper to be wound.

As noted previously, the activator means is preferably electrically powered, although other forms of power may be employed provided that the activator means functions as set forth herein. More preferably, the activator means is powered by a direct current (D. C.) power source. Such D. C. power may be derived from solar cells, one or more storage batteries, A. C. power converted to D. C. by, for example, a rectifier and transformer arrangement and the like.

The activator means preferably includes an electrical relay means, e.g., to provide communication between the activator means and the motive means, to allow the activator means to activate the motive means in response to the presence of paper to be wound.

The present apparatus preferably further comprises first paper guide means located before the contact switch assembly and a second paper guide means located after the contact switch means. The first and second paper guide means act to guide paper to be wound in proximity to the contact switch assembly (e.g., to provide for proper functioning of such contact switch assembly) and onto the spool means. As with the spool means, it is preferred that the first and second paper guide means be adjustable to allow paper of differing widths to be wound.

In the circumstance where a particular side (e.g., the unused side) of the paper to be wound is to be available for use as a printing medium, care must be exercised to provide for such availability. For example, if the rewound roll of paper is to be used in the same printing device or system as the original roll of paper, the rewound roll must be inverted relative to the original paper roll. That is, if the printing device or system prints on the top side of the paper, the present apparatus must be configured to provide that the unused side of the paper is on the top side of the rewound roll of paper. Careful consideration to the rotation direction of the spool means will provide proper orientation of the paper in the rewound roll. Thus, when the present apparatus is used to rewind a partially used (on one side) roll of paper for reuse, the apparatus is preferably configured to automatically invert the paper upon rewinding so that the unused side of the paper is available for use, e.g., as a printing medium.

BRIEF DESCRIPTION OF THE DRAWINGS

These and other aspects of the present invention are set forth in the following detailed description and claims, particularly when considered in conjunction with the accompanying drawings, in which like parts bear like reference numerals.

DESCRIPTION OF THE PREFERRED EMBODIMENT

Figure 1:
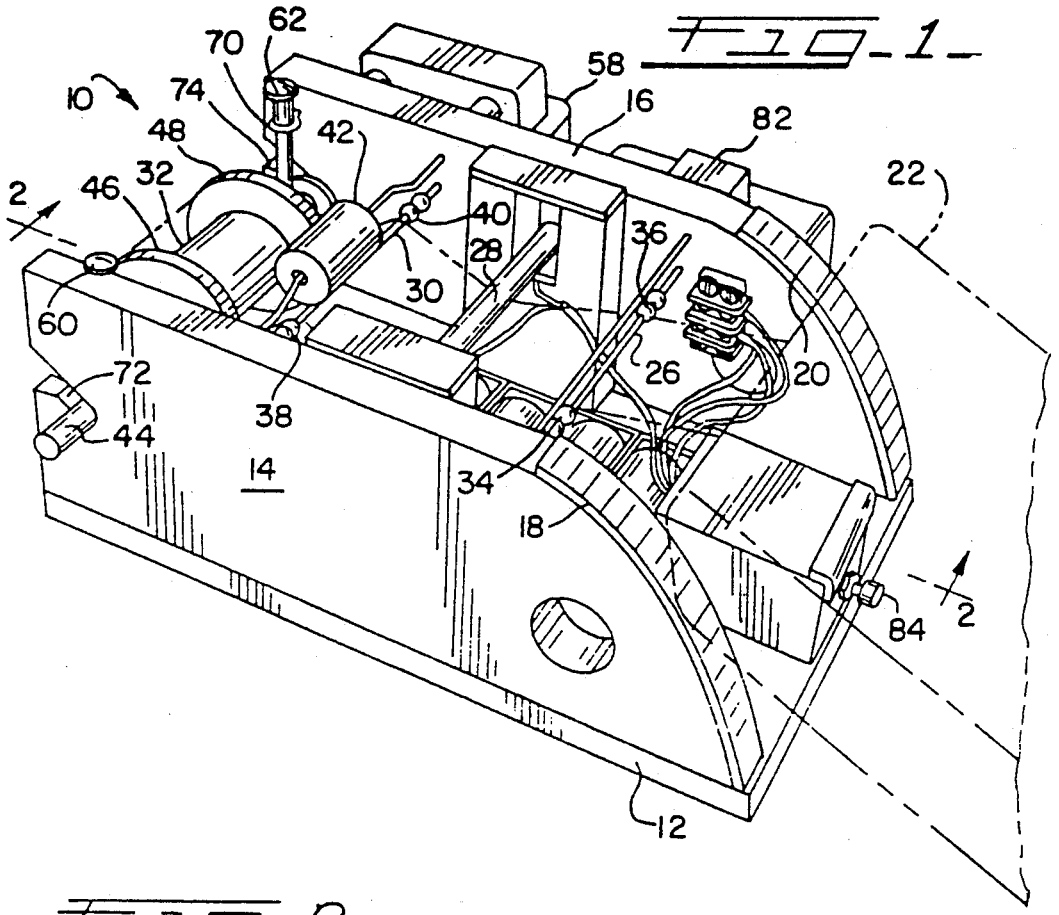
FIG. 1 is a side front view, in perspective, of one embodiment of the present invention.

Referring to the drawings, a paper winding apparatus, shown generally at 10, is supported by and housed in floor 12, first wall 14 and second wall 16. Affixed to the curved edges of both first and second walls 14 and 16 are first notched element 18 and second notched element 20, respectively. First and second notched elements 18 and 20 each include a series of notches to facilitate holding printing device 22 (shown in shadow lines) in abutting relation to apparatus 10. This abutting relation, in turn, conveniently allows paper 24 which has been printed on one side by printing device 22 to be provided by apparatus 10 for reuse. Printing device 22 can abut apparatus 10 at any one of a number of angles depending, for example, on space constraints, configuration of printing device 22, etc. It should be noted that apparatus 10 need not abut printing device 22. For example, apparatus 10 may be placed anywhere in back of printing device 22, on a desk, on the floor, etc. Care should be exercised so that the segment of paper 24 between apparatus 10 and printing device 22 remains untwisted. In any event, printing device 22 is associated with apparatus 10 so that paper 24 can be conveniently and effectively rewound for reuse.

Following the path of paper 24 through apparatus 10, paper 24 contacts the top of front paper guide 26, contacts the bottom of electrically conductive bar 28, contacts the top of back paper guide 30 and is received on spool 32. Paper 24 is fitted between front width adjusters 34 and 36 located on front paper guide 26, and between back width adjusters 38 and 40 on front paper guide 26 and back paper guide 30, respectively, can be adjusted to allow differing widths of paper to be processed (wound) by apparatus 10. Associated with back paper guide 30 is cylinder 42 which is located in close proximity to back paper guide 30. Cylinder 42, in cooperation with rear paper guide 30, acts to keep paper 24 aligned as it is received onto spool 32 and also to keep paper 24 taut between rear paper guide 30 and spool 32. The leading edge of paper 24 is taped or otherwise secured to spool 32 to allow paper 24 to be wound around spool 32.

Spool 32 is removably secured to drive rod 44. Adjustable spool ends 46 and 48 are located on drive rod 44, are removably secured i.e., threaded, to the ends of spool 32. Adjustable spool ends 46 and 48 can accommodate spool widths so that differing widths of paper may be wound by apparatus 10. Thus, the only adjustment which is required to use different widths of paper is adjusting the spacing of spool ends 46 and 48. This adjustment is relatively simple and easy to make, and hence avoids undue loss of time. The combination of adjustable spool ends 46 and 48, spool 32, drive rod 44 and a spring-like adjustment rod (not shown) located between spool 32 and drive rod 44 can act to removably secure spool 32 to drive rod 44. In this embodiment, spool 32 can be removed from drive rod 44 by removing spool end 46 from spool 32 and drive rod 44. This releases the tension on the adjustment rod and allows spool 32 to be removed from drive rod 44. This spring-like adjustment rod may be adapted to allow the use of different sized spools (e.g. having different diameter central openings) so that different sized spools can be easily interchanged without an undue loss of time. Other suitable means of removably securing spool 32 to drive rod 44 may be employed within the scope of the present invention.

Drive rod 44 includes a collar 50 secured thereto and, when apparatus 10 is in use, located in close proximity to the inside of second wall 16. Also secured to drive rod 44 is rod gear 52 which, when apparatus 10 is in use, is located near the outside of second wall 16 and is in mating relation to motor gear 54 which, in turn, is fastened to shaft 56 of motor 58, which may be a high torque, low voltage D.C. motor powered by one or more solar cells or storage batteries, or an A.C. motor powered by conventional A.C. line voltage (e.g., 117-125 VAC). The use of storage batteries and, in particular, solar cells provides portability to the present system. Thus, such D.C. power sources allow the present apparatus to be used in remote places, e.g., where A.C. electric power is unavailable.

Both collar 50 and rod gear 52 are sized and located on drive rod 44 so as not to be able to pass through through slot 74. Thus, drive rod 44 is held substantially stationary along its longitudinal axis. First and second pins 60 and 62 are removably fitted into first fittings 64 and 66, and second fittings 68 and 70, respectively, which in turn are secured to the inside of first and second walls 14 and 16, respectively. When apparatus 10 is in use, first and second pins 60 and 62 act to hold drive rod 44 in place in through slots 72 and 74. The combination of, collar 50, rod gear 52, and first and second pins 60 and 62 act to hold drive rod 44 in a position so that rod gear 52 maintains mating relation to motor gear 54. Drive rod 44 can be removed from apparatus 10 by removing first and second pins 60 and 62 from first and second fittings 64, 66 and 68, 70, respectively. Drive rod 44 is then removed via through slots 72 and 74 in first and second walls 14 and 16, respectively. Through slots 72 and 74 are both open ended at the back of apparatus 10 and incline downwardly toward floor 12. Such structure and orientation of through slots 72 and 74 enhance the easy detachment and attachment of drive rod 44 and associated components from and to the remainder of apparatus 10, and facilitate holding drive rod 44 and associated components in place while apparatus 10 is in use. With drive rod 44 removed, spool 32 (along with a roll of wound paper 24) can be removed and replaced by another spool. Drive rod 44 is put back in place via through slots 72 and 74, so that rod gear 52 is in mating relation to motor gear 54, and first and second pins 60 and 62 are replaced in first and second fittings 64, 66 and 68, 70, respectively. Since rod gear 52 is removed along with spool 32, there is no chance of accidental injury, e.g., caused by getting one's fingers caught between rotating gears. This is an important safety feature of the present invention.

Figure 6:
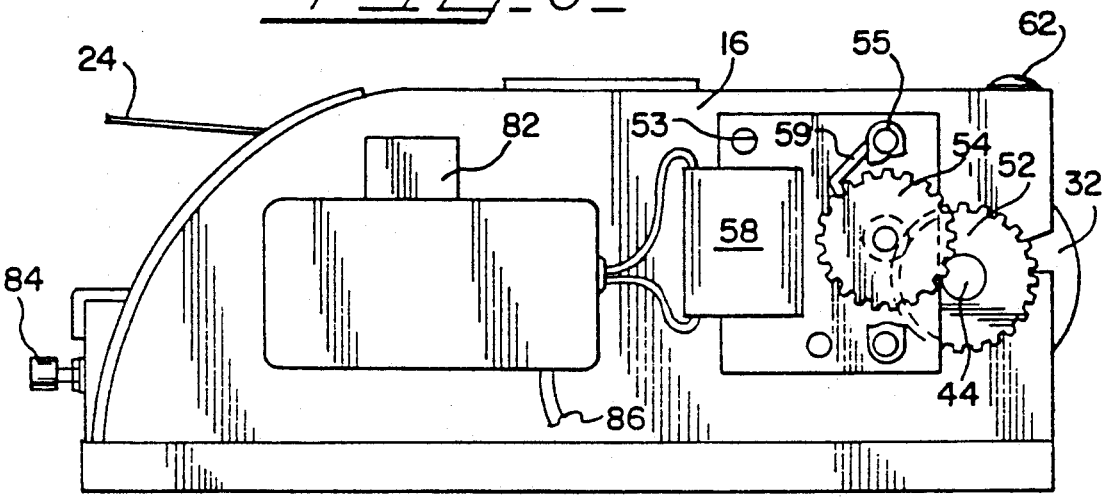
FIG. 6 is a plan view of the outside of wall 16.

As shown in FIG. 6, gear latch 59 is associated with motor gear 54. Gear latch 59 is attached to second wall 16, e.g., by means of motor mounting screw 55. When rod gear 52 is in mating relation to motor gear 54, gear latch 59 contacts motor gear 54 as shown in FIG. 6. Gear latch 59 is configured to allow rod gear 52 to rotate freely in response to the rotation of motor gear 54 so that paper 24 can be wound around spool 32. When motor gear 54 is not rotating in response to motor 58, gear latch 59 contacts motor gear 54, and acts to prevent any substantial reverse rotation of drive rod 44 (and any substantial unwinding of paper 24 already wound on spool 32). Gear latch 59 remains in contact with motor gear 54 while first and second pins 60 and 62 remain in place. Gear latch 59 may be constructed of any suitable material, e.g., metal, nylon, plastic, etc.

Figure 2:
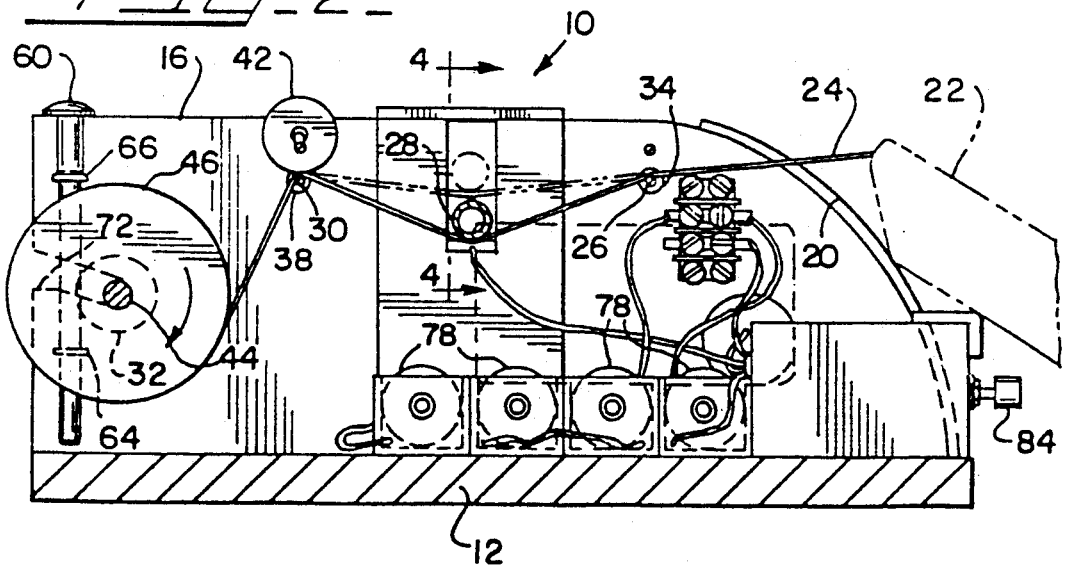
FIG. 2 is an elevational view taken along line 2—2 of FIG. 1.
Figure 3:
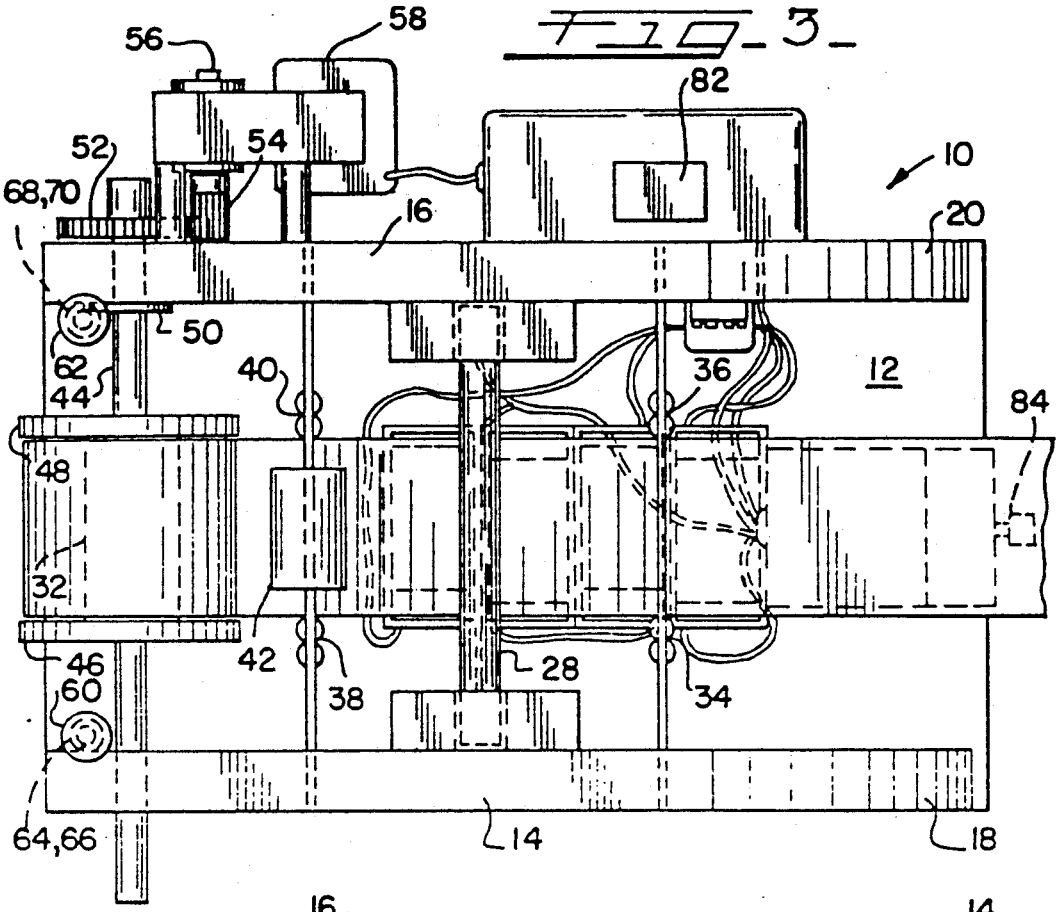
FIG. 3 is a top elevational view of the embodiment of the present invention shown in FIG. 1.
Figure 4:
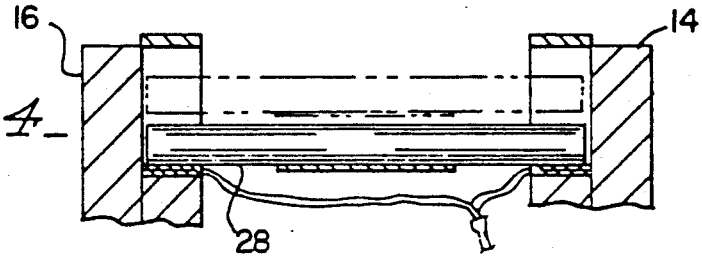
FIG. 4 is a plan view taken along line 4—4 of FIG. 2.

Electrically conductive bar 28 is part of a contact switch assembly 76. Referring to FIGS. 2 and 4, when bar 28 is in the up position (shown by shadow lines), contact switch assembly 76 (see FIG. 5) is in the open position, and when bar 28 is in the down position, contact switch assembly 76 is in the closed position. When contact switch assembly 76 is in the closed position, electrical current flows across bar 28.

Figure 5:
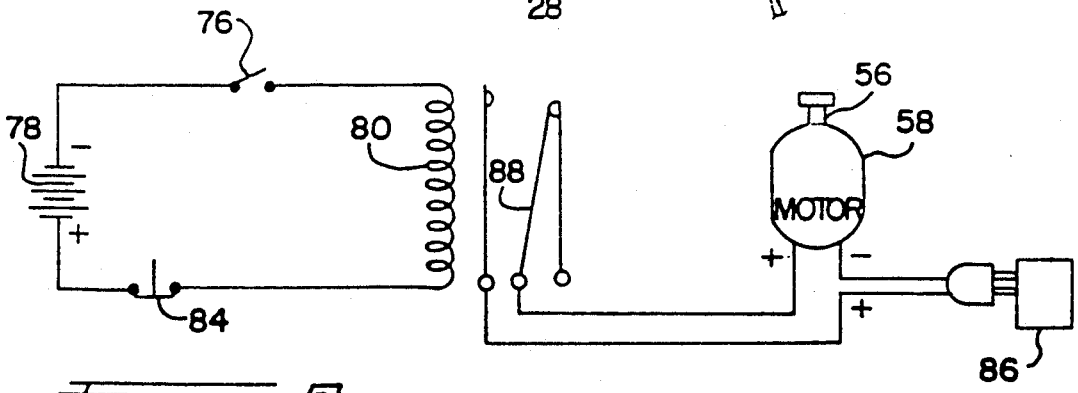
FIG. 5 is an electrical schematic diagram of the circuit involved in the embodiment of the present invention shown in FIG. 1.

For a better understanding of the operation of contact switch assembly 76, refer to FIG. 5. A D.C. power source 78, e.g., one or more solar cells and/or storage batteries (such as four batteries connected in series), are connected in series to contact switch assembly 76, coil 80 of relay 82, and to push-button switch 84. Push-button switch 84, in the closed position, allows apparatus 10 to operate normally. However, if it is desired to render apparatus 10 inoperable, e.g., for maintenance, etc., push-button switch 84 can be moved to the open position. For discussion purposes, it will be assumed that push-button switch 84 is closed.

With contact switch assembly 76 in the open position, apparatus 10 is inoperative and no paper 24 is wound. However, when contact switch assembly 76 is in the closed position, current flows through relay coil 80 causing relay switch 88 of relay 82 to close, thereby activating motor 58, which is connected to an appropriate power source 86, e.g., A.C. line voltage, solar cells or storage batteries. The action of motor 58 along with the gearing arrangement discussed previously causes drive rod 44 and spool 32 to rotate, thereby winding paper 24. The configuration of apparatus 10, in particular the direction of rotation of drive rod 44, should be selected to insure that the unused side of paper 24 will be available for use. If such configuration is chosen, apparatus 10 automatically inverts paper 24 upon rewinding so that the unused side of paper 24 becomes available for use. When bar 28 is lifted to its up position, by the force of paper 24 becoming taut, contact switch assembly 76 moves to its open position, relay switch 88 of relay 82 moves to its open position, motor 58 is deactivated, drive rod 44 and spool 32 stop rotating and no more paper 24 is wound. Bar 28 should be weighted so that it can be lifted to its up position by the force of paper 24 becoming taut underneath bar 28 and so that it will fall to its down position when paper 24 underneath bar 28 is not taut.

Briefly, apparatus 10 functions as follows. After proper spool selection, drive rod 44 is placed and secured in slots 72 and 74 and is ready for use. The leading edge of paper 24 is threaded through apparatus 10, as described previously, and is secured to spool 32. Paper 24 is threaded so that bar 28 is supported in its up position by the tautness of paper 24. As printing device 22 used more paper 24, the paper 24 in apparatus 10 (specifically underneath bar 28) loses its tautness and is no longer able to support bar 28 in its up position. As bar 28 falls to its down position, motor 58 is activated and drive rod 44 and spool 32 rotate thereby winding paper 24 around spool 32. Such rotation continues until no more paper 24 is available to be wound and the tautness of paper 24 underneath bar 28 forces bar 28 into its up position. This cycle is repeated as printing device 22 uses more paper 24.

While this invention has been described with respect to various specific examples and embodiments, it is to be understood that the invention is not limited thereto and that it can be variously practiced within the scope of the following claims.

What is claimed is:

1. An apparatus for winding paper comprising spaced apart first and second walls having first and second through slots, respectively; a spool assembly adapted to receive said paper and around which said paper is wound, said spool assembly including the following components: a spool to receive said paper and being located between said first and second walls, a drive rod adapted to be placed in said first and second through slots and to which said spool is secured, a rod gear secured to said drive rod, and a collar secured to said drive rod away from said rod gear a distance so that said collar and said rod gear are separated by said second wall, said spool assembly being removable from said apparatus a single unit; first and second pins removably secured to said first and second walls, respectively, and acting to hold said drive rod in said first and second through slots; and a motor including a motor shaft and a single motor gear fastened to said motor shaft, said single motor gear being in direct mating relation with said rod gear so that rotation of said single motor gear causes said spool to rotate to thereby cause said paper to be wound around said spool; said collar and said rod gear acting to substantially prevent longitudinal movement of said drive rod and, together with said first and second pins, acting to maintain said direct mating relation between said single motor gear and said rod gear.

2. The apparatus of claim 1 wherein said first and second slots each have one open end and said drive rod is in direct contact with at least one of said first and second walls.

3. The apparatus of claim 1 wherein said first and second slots are inclined downwardly and said first and second pins are located outside said first and second slots, respectively.

4. The apparatus of claim 1 which further comprises first and second fittings secured to said first and second walls, respectively, and adapted to provide for the removable securement of said first and second pins to said first and second walls, respectively.

5. The apparatus of claim 4 which includes two of said first fittings and two of said second fittings.

6. The apparatus of claim 1 wherein said spool assembly is adjustable to allow paper of differing widths to be wound.

7. The apparatus of claim 1 wherein said motor comprises an electric motor.

8. The apparatus of claim 1 wherein said paper to be wound has a used side and an unused side and said used side has previously been used in a printing medium by a printing device, and said apparatus is configured to automatically invert said paper so that winding said paper makes said unused side available for use as a printing medium by said printing device.

9. The apparatus of claim 1 wherein said motor includes a high torque, low voltage D.C. motor powered by one or more solar cells.

10. The apparatus of claim 1 which further comprises activator means associated with said motor and being capable of activating said motor to rotate said spool assembly in response to the presence of paper to be wound.

11. The apparatus of claim 10 wherein said activator means includes a contact switch assembly having an open position in which said activator means does not activate said motor and a closed position in which said activator means does activate said motor, said contact switch assembly moving from said open position to said closed position in response to the presence of paper to be wound.

12. The apparatus of claim 10 wherein said activator means includes off switch means capable of being activated to render said activator means unresponsive to the presence of paper to the wound.

13. The apparatus of claim 10 wherein said activator means is powered by a D.C. power source.

14. The apparatus of claim 10 wherein said activator means includes an electrical relay means to activate said motor in response to the presences of paper to be wound.

15. The apparatus of claim 10 which further comprises first paper guide means located before said contact switch means and second paper guide means located after said contact switch means, said first and second paper guide means acting to guide paper to be wound in proximity to said contact switch means and onto said spool assembly.

16. The apparatus of claim 15 wherein said spool assembly and said first and second paper guide means are adjustable to allow paper of differing widths to be wound.

17. The apparatus of claim 10 wherein said activator means is capable of activating said motor to rotate said spool assembly in response to gravitational forces caused by the presence of paper to be wound.

* * * * *